US007161608B2

(12) United States Patent
Pettitt et al.

(10) Patent No.: US 7,161,608 B2
(45) Date of Patent: Jan. 9, 2007

(54) DIGITAL SYSTEM AND METHOD FOR DISPLAYING IMAGES USING SHIFTED BIT-WEIGHTS FOR NEUTRAL DENSITY FILTERING APPLICATIONS

(75) Inventors: Gregory S. Pettitt, Rowlett, TX (US); Harold E. Bellis, II, Garland, TX (US); Jason R. Thompson, Garland, TX (US); James F. Headley, McKinney, TX (US); Dana F. Segler, Jr., Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 498 days.

(21) Appl. No.: 10/753,795

(22) Filed: Jan. 7, 2004

(65) Prior Publication Data

US 2005/0146541 A1 Jul. 7, 2005

(51) Int. Cl.
*G09G 5/10* (2006.01)

(52) U.S. Cl. ..... 345/690; 345/692; 348/771

(58) Field of Classification Search ..... 345/32, 345/84, 690, 691, 692, 694; 359/290, 298, 359/303; 348/678, 770, 771; 355/71; 357/317
See application file for complete search history.

(56) References Cited

U.S. PATENT DOCUMENTS 5,812,303 A 9/1998 Hewlett et al.

FOREIGN PATENT DOCUMENTS

JP 07-114038 * 5/1995

* cited by examiner

*Primary Examiner*—Richard Hjerpe
*Assistant Examiner*—Abbas I. Abdulselam
(74) *Attorney, Agent, or Firm*—Charles A. Brill; Wade James Brady, III; Frederick J. Telecky, Jr.

(57) ABSTRACT

Disclosed herein are visual display systems and methods capable of having shifted bit-weights in neutral density filtering (NDF) applications. In one embodiment, a method (200) of displaying an image comprises transmitting light through an optical filter (17) comprising at least one high transmissivity portion configured to output light at an initial intensity, and at least one low transmissivity portion configured to output light at a lower intensity than the initial intensity, where the initial intensity and lower intensity output light illuminates a spatial light modulator (14). The method also includes providing a plurality of data bits (non-ND) from a predetermined number of data bits (B0–B7), where each of the plurality comprises a pulse-width longer than a load-time for operating the spatial light modulator (14). In this embodiment, the method further includes providing at least one data bit (ND) from the predetermined number of data bits, where the at least one data bit comprises an initial pulse-width less than the load-time and comprises an adjusted pulse-width greater than the load-time. Then, the method further comprises operating selected portions of the spatial light modulator (14) in coordination with the initial intensity and lower intensity output light using the pulse-widths of one or more of the plurality of data bits (non-ND) and the adjusted pulse-width of the at least one data bit (ND).

30 Claims, 2 Drawing Sheets

(NON-ND)

| | (B0) 1 | (B1) 2 | (B2) 4 | (B3) 8 | (B4) 16 | (B5) 32 | (B6) 64 | (B7) 128 |
|---|---|---|---|---|---|---|---|---|
| 1 | 1 | 0 | 0 | 0 | 0 | 0 | 0 | 0 |
| 2 | 0 | 1 | 0 | 0 | 0 | 0 | 0 | 0 |
| 3 | 1 | 1 | 0 | 0 | 0 | 0 | 0 | 0 |

*FIG. 3*

| | (ND) | | | | (NON-ND) | | | |
|---|---|---|---|---|---|---|---|---|
| | (B0) .25 | (B1) .5 | (B2) 1 | (B3) 2 | (B4) 4 | (B5) 8 | (B6) 16 | (B7) 32 |
| 1 | 0 | 0 | 1 | 0 | 0 | 0 | 0 | 0 |
| 2 | 0 | 0 | 0 | 1 | 0 | 0 | 0 | 0 |
| 3 | 0 | 0 | 1 | 1 | 0 | 0 | 0 | 0 |

*FIG. 4*

| | (ND) | | | | (NON-ND) | | | |
|---|---|---|---|---|---|---|---|---|
| | (B0) .25 | (B1) .5 | (B2) 1 | (B3) 2 | (B4) 2 | (B5) 4 | (B6) 8 | (B7) 16 |
| 1 | 0 | 1 | 0 | 0 | 1 | 0 | 0 | 0 |
| 2 | 0 | 0 | 0 | 0 | 1 | 0 | 0 | 0 |
| 3 | 0 | 0 | 1 | 0 | 1 | 0 | 0 | 0 |

*FIG. 5*

| | (ND) | | | (NON-ND) | | | | |
|---|---|---|---|---|---|---|---|---|
| | (B0) .33 | (B1) .66 | (B2) 1 | (B3) 3 | (B4) 9 | (B5) 15 | (B6) 27 | (B7) 42 |
| 3 | 0 | 0 | 0 | 1 | 0 | 0 | 0 | 0 |
| 4 | 0 | 0 | 1 | 1 | 0 | 0 | 0 | 0 |
| 5 | 1 | 1 | 1 | 1 | 0 | 0 | 0 | 0 |

*FIG. 6*

DIGITAL SYSTEM AND METHOD FOR DISPLAYING IMAGES USING SHIFTED BIT-WEIGHTS FOR NEUTRAL DENSITY FILTERING APPLICATIONS

TECHNICAL FIELD

Disclosed embodiments herein relate generally to visual display systems and methods employing digital micro-mirror devices, and more particularly to visual display systems and methods capable of having shifted bit-weights in neutral density filtering (NDF) applications.

BACKGROUND

Video display systems based on spatial light modulators (SLMs) are increasingly being used as an alternative to display systems using cathode ray tubes (CRTs). SLM systems provide high-resolution displays without the bulk and power consumption of CRT systems. As used for image display applications, SLMs include arrays of micro-mirrors that reflect light to an image plane. These micro-mirrors are often referred to as picture elements or "pixels", as distinguished from the pixels of an image. This use of terminology is typically clear from context, so long as it is understood that more than one pixel of the SLM array may be used to generate a pixel of the displayed image.

Digital micro-mirror devices (DMDs) are a type of SLM, and may be used for either direct-view or projection display applications. A DMD has an array of hundreds or even thousands of micro-mechanical pixels, each having a tiny mirror that is individually addressable by an electronic signal. Depending on the state of its addressing signal, each pixel tilts so that it either does or does not reflect light to the image plane.

Generally, projecting an image from an array of pixels is accomplished by loading memory cells connected to the pixels. Once each memory cell is loaded, the corresponding pixels are reset so that each one tilts in accordance with the ON or OFF state of the data in the memory cell. For example, to produce a bright spot in the projected image, the state of the pixel may be ON, such that the light from that pixel is directed out of the SLM and into a projection lens. Conversely, to produce a dark spot in the projected image, the state of the pixel may be OFF, such that the light is directed away from the projection lens.

To achieve intermediate levels of illumination, between white (ON) and black (OFF), pulse-width modulation (PWM) techniques may be employed. The basic PWM scheme involves first determining the rate at which images are to be presented to the viewer. This establishes a frame rate and a corresponding frame-time or frame period. For example, in many modern television systems images are transmitted at 60 frames per second (i.e., 60 Hz), and each frame lasts for approximately 16.67 milliseconds. Then, the intensity resolution for each pixel is established. In a simple example, and assuming n bits of resolution, the frame-time is divided into $2^{n-1}$ equal time slices. For a 16.67 millisecond frame period and n-bit intensity values, the time slice is $16.67/(2^{n-1})$ milliseconds.

Having established these times, for each frame of the desired image pixel intensities are quantized, such that black is 0 time slices, which is the intensity level represented by the least significant bit (LSB). The LSB is the least amount of illumination intensity from the DMD and is 1 time slice, while maximum brightness, e.g., the most significant bit (MSB), is $2^{n-1}$ time slices. Each pixel's quantized intensity determines its on-time during a frame period. Thus, during a frame period, each pixel with a quantized value of more than 0 is ON for the number of time slices that correspond to its intensity. The viewer's eye integrates the pixel brightness so that the image appears as if it were generated with analog levels of light.

For generating color images with SLMs, one approach is to use three DMDs, one for each primary color of red, green, and blue (RGB). The light from corresponding pixels of each DMD is converged so that the viewer perceives the desired color. Another approach is to use a single DMD and a color wheel having sections of primary colors. Data for different colors is sequenced and synchronized to the color wheel so that the eye integrates sequential images into a continuous color image. Another approach uses two DMDs, with one switching between two colors and the other displaying a third color.

For addressing SLMs, PWM calls for the data to be formatted into "bit-planes," each bit-plane corresponding to bit-weights of intensity values. Thus, if each pixel's intensity is represented by an n-bit value, each frame of data has n bit-planes. Each bit-plane has a 0 or 1 value for each display element. In the simple PWM example described above, during a frame period, each bit-plane is separately loaded and the pixels are addressed according to their associated bit-plane values. For example, the bit-plane representing the LSBs of each pixel is displayed for 1 time slice, whereas the bit-plane representing the MSBs is displayed for 2n/2 time slices. Because a time slice is only $16.67/(2^{n-1})$ milliseconds, the SLM must be capable of loading the LSB bit-plane (which is the shortest bit-plane) within that time. The time for loading the LSB bit-plane is the "peak data rate." In conventional systems, when the LSB is less than the load-time of the DMD, then that bit cannot be used and image quality and efficiency suffers.

As with all display systems, the quality of the images from a DMD-based display system is improved by eliminating artifacts. Potential artifacts include temporal contouring, motion contouring, and the like. Another potential impact to the quality of the final image is altered or lost color performance generated by the display system. For example, in systems employing color wheels, such as those described above, problems with the design and/or construction of the color filters on the color wheel can affect color performance. In one specific situation, conventional filter manufacturing techniques often result in the color slope of the color filter increasing as the transmission of the filter is decreased. Such slope alteration is typically caused by a recycling effect of light as it passes through the filter. In systems employing neutral density filtering (NDF), which involves increasing the PWM signal length of a color bit to a useable length beyond the load-time while decreasing the color's intensity/amplitude with lower transmissive filter segments, the decreased transmissivity of the ND filter segments typically results in such decreased color performance. Accordingly, a need exists to compensate for such decreased color performance, especially in visual display systems that employ NDF techniques.

BRIEF SUMMARY

Disclosed herein are visual display systems and methods capable of having shifted bit-weights in neutral density filtering (NDF) applications. In one embodiment, a method of displaying an image comprises transmitting light through an optical filter comprising at least one high transmissivity portion configured to output light at an initial intensity, and at least one low transmissivity portion configured to output light at a lower intensity than the initial intensity, where the initial intensity and lower intensity output light illuminates a spatial light modulator. The method also includes providing a plurality of data bits from a predetermined number of data bits, where each of the plurality comprises a pulse-width longer than a load-time for operating the array. In this embodiment, the method further includes providing at least one data bit from the predetermined number of data bits, where the at least one data bit comprises an initial pulse-width less than the load-time and comprises an adjusted pulse-width greater than the load-time. Then, the method further comprises operating selected portions of the spatial light modulator in coordination with the initial intensity and lower intensity output light using the pulse-widths of one or more of the plurality of data bits and the adjusted pulse-width of the at least one data bit.

In another aspect, a visual display device is disclosed, and may comprise an optical filter configured to transmit light therethrough and onto a spatial light modulator, where the optical filter comprises at least one high transmissivity portion configured to output light at an initial intensity, and at least one low transmissivity portion configured to output light at a lower intensity than the initial intensity. The device may further include a plurality of data bits from a predetermined number of data bits, where each of the plurality comprises a pulse-width longer than a load-time for operating the spatial light modulator. In addition, the device may include at least one data bit from the predetermined number of data bits, where the at least one data bit comprises an initial pulse-width less than the load-time and an adjusted pulse-width greater than the load-time. In such an embodiment, selected portions of the spatial light modulator are configured to operate in coordination with the initial intensity and lower intensity output light based on the pulse-widths of one or more of the plurality of data bits and the adjusted pulse-width of the at least one data bit.

BRIEF DESCRIPTION OF THE DRAWINGS

For a more complete understanding of the present invention, and the advantages thereof, reference is now made to the following descriptions taken in conjunction with the accompanying drawings, in which:

FIG. 3 illustrates a table that sets forth bit-weights for exemplary bit-planes in a typical 8-bit system;

FIG. 4 illustrates a table that sets forth bit-weights for exemplary bit-planes in an 8-bit system employing ND bits;

FIG. 5 illustrates another table that sets forth bit-weights for exemplary bit-planes in an 8-bit system employing ND bits and non-ND bits; and FIG. 6 illustrates another table illustrating non-binary and non-linear bit-weights for a given set of bit-planes in another embodiment of an 8-bit system.

DETAILED DESCRIPTION OF PREFERRED EMBODIMENTS

Figure 1:
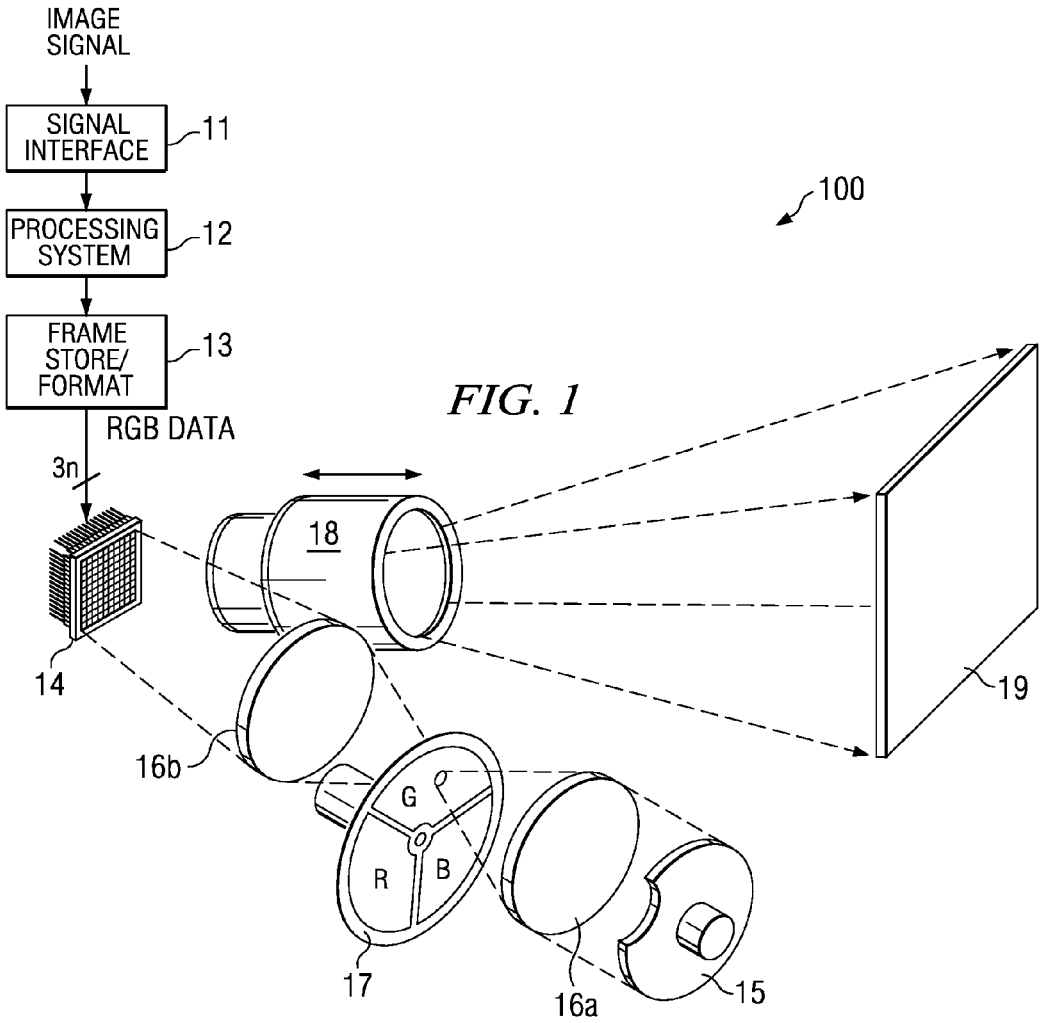
FIG. 1 illustrates one embodiment of a projection display system, which uses an SLM having a DMD therein to generate real-time images from an input signal.

Referring initially to FIG. 1, illustrated is one embodiment of a projection visual display system 100, which uses an SLM having a DMD 14 therein to generate real-time images from an input signal. The input image signal may be from a television tuner, MPEG decoder, video disc player, video cassette player, PC graphics card, or the like. Only those components significant to main-screen pixel data processing are shown. Other components, such as might be used for processing synchronization and audio signals or secondary screen features, such as closed captioning, are not shown for simplicity.

In the illustrated embodiment, an input image signal, which may be an analog or digital signal, is input to a signal interface unit 11. In embodiments where the input signal is analog, an analog-to-digital converter (not illustrated) may be employed to convert the incoming signal to a digital data signal. Signal interface unit 11 receives the data signal and separates video, synchronization, and audio signals. In addition, a Y/C separator is also typically employed, which converts the incoming data from the image signal into pixel-data samples, and which separates the luminance ("Y") data from the chrominance ("C") data, respectively. Alternatively, in other embodiments, Y/C separation could be performed before A/D conversion.

The separated signals are then input to a processing system 12. Processing system 12 prepares the data for display, by performing various pixel data processing tasks. Processing system 12 may include whatever processing components and memory useful for such tasks, such as field and line buffers. The tasks performed by the processing system 12 may include linearization (to compensate for gamma correction), colorspace conversion, and interlace to progressive scan conversion. The order in which any or all of the tasks performed by the processing system 12 may vary.

Once the processing system 12 is finished with the data, a display memory module 13 receives processed pixel data from the processing system 12. The display memory module 13 formats the data, on input or on output, into bit-plane format, and delivers the bit-planes to the SLM. As discussed in the Background section, the bit-plane format permits single or multiple pixels on the DMD 14 to be turned on or off in response to the value of one bit of data, in order to generate one layer of the final display image. In one embodiment, the display memory module 13 is a "double buffer" memory, which means that it has a capacity for at least two display frames. In such a module, the buffer for one display frame may be read out to the SLM while the buffer for another display frame is being written. To this end, the two buffers are controlled in a "ping-pong" manner so that data is continuously available to the SLM.

For the next step in generating the final desired image, the bit-plane data from the display memory module 13 is delivered to the SLM. Although this description is in terms of an SLM having a DMD 14 (as illustrated), other types of SLMs could be substituted into display system 100. Details of a suitable SLM are set out in U.S. Pat. No. 4,956,619, entitled "Spatial Light Modulator", which is commonly owned with the present disclosure and incorporated herein by reference in its entirety. In the case of the illustrated DMD-type SLM, each piece of the final image is generated by one or more pixels of the DMD, as described above. Essentially, the SLM uses the data from the display memory module 13 to address each pixel on the DMD 14. The "ON" or "OFF" state of each pixel forms a black or white piece of the final image, and an array of pixels on the DMD 14 is used to generate an entire image frame. Each pixel displays data from each bit-plane for a duration proportional to each bits PWM weighting, which is proportional to the length of time each pixel is ON, and thus its intensity in displaying the image. In the illustrated embodiment, each pixel of DMD 14 has an associated memory cell to store its instruction bit from a particular bit-plane.

For each frame of the image to be displayed, Red, Green, Blue (RGB) data may be provided to the DMD 14 one color at a time, such that each frame of data is divided into red, blue, and green data segments. Typically, the display time for each segment is synchronized to a color wheel 17, which rotates so that the DMD 14 displays the data for each color through the color wheel 17 at the proper time. Thus, the data channels for each color (RGB) are time-multiplexed so that each frame has sequential data for the different colors. Moreover, in systems employing neutral-density (ND) color filtering, the color wheel 17 may include additional sections for illuminating ND versions of the basic RGB colors. A detailed description of ND filtered illumination using a color wheel may be found in U.S. Pat. No. 5,812,303, which is commonly owned with the present disclosure and incorporated herein by reference in its entirety.

For a sequential color system, such as the system 100 illustrated in FIG. 1, a light source 15 provides white light through a condenser lens 16*a*, which focuses the light to a point on the rotating color wheel 17. A second lens 16*b* may be employed to fit the colored light to the size of the pixel array on the DMD 14. Reflected light from the DMD 14 is transmitted to a display lens 18. The display lens 18 typically includes optical components for illuminating an image plane, such as a display screen 19.

In an alternative embodiment, the bit-planes for different colors could be concurrently displayed using multiple SLMs, one for each color component. The multiple color displays may then be combined to create the final display image. Of course, a system or method employing the principles disclosed herein is not limited to either embodiment.

Figure 2:
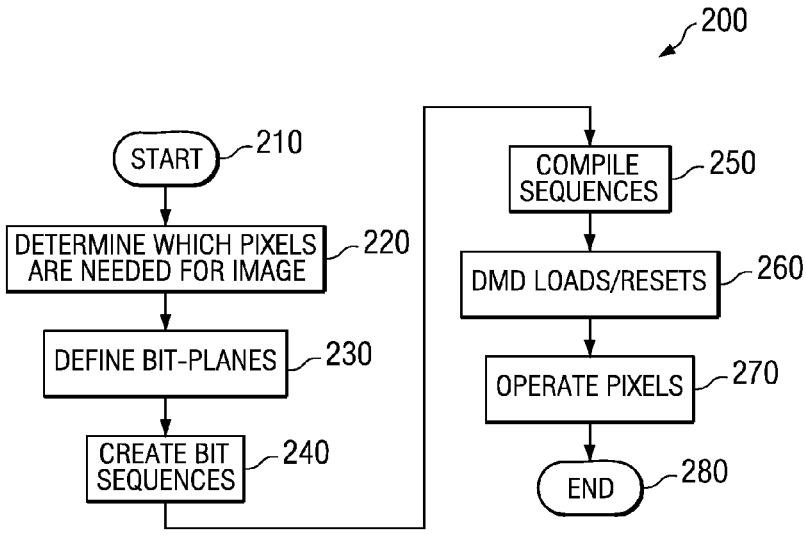
FIG. 2 illustrates a flow diagram detailing the function of the processing system and display memory module illustrated in FIG. 1.

Turning now to FIG. 2, illustrated is a flow diagram 200 detailing the function of the processing system 12 and display memory module 13 illustrated in FIG. 1. The process begins at a start step 210, which may include the receipt of the incoming image signal, as well as any decoding of the signal that may be required.

At block 220, a determination is made of which pixels on the DMD (for example, the DMD 14 in FIG. 1) are to be turned ON, and which are to be turned OFF, in order to create the desired image. In addition, at block 220, the duration each pixel is to be left ON is determined. The "on-time" of each pixel establishes the intensity provided to the specific portion of the image (e.g., an illustrated pixel of the displayed image) by each specific DMD pixel. Once the determination of which pixels are to be turned ON, as well as each pixel's individual on-time, is made, the process moves to block 230.

At block 230, the bit-planes that will be used to "build" the final displayed image are defined. The bit-planes correspond to the various levels of grayscale (i.e., levels of brightness between white and black) available to project an image. For example, in a binary 8-bit display system, there will typically be 256 bit-planes ($2^8$) created for a single frame of the image being displayed. In addition, each of those bit-planes is defined by 8 bits (in this example), where each bit corresponds to the intensity of the selected pixels. At block 240, bit sequences are created that set forth the order and intensity for operating selected ones of the pixels on the DMD. Moreover, such bit sequences are generated for each bit-plane in order to properly operate the DMD to display a complete final image.

In many embodiments, it may be desirable to split the bits in each of the bit-planes such that they are executed by the DMD in segments. In these embodiments, the specific pixels used to execute a single bit are operated multiple times at different periods during the frame-time, rather than executing the bit in one continuous operation, by activating select pixels and keeping them ON for the entire length of the bit. Examples of such segmenting, as well as the advantages associated therewith, may be found in U.S. Pat. No. 5,969,710, which is commonly assigned with the present disclosure and incorporated herein by reference in its entirety.

Once the bit sequences have been created, the process moves to block 250. At block 250, a complier is employed to compile the bit sequences and convert them into PWM signals. As stated above, the intensity to be executed by the pixels corresponds to the length of time the selected pixels are held ON. Thus, since the bits defining the bit-plane are also defining the on-time for the selected pixels, each of those bits (and thus the corresponding on-times of the selected pixels) may be represented by high and low PWM signals. These PWM signals are generated from the bit sequences by the complier for use as ON/OFF signals to the individual pixels located on the DMD in order to operate the DMD to generate the desired image.

After the necessary PWM signals are generated, the process moves to block 260. At this block, the PWM signals are applied to the DMD for creating the image. Specifically, the PWM signals are loaded into the display memory module 13 and stored until ready for use to operate the DMD. After all the required PWM signals have been loaded and stored, the pixels on the DMD are "reset" in accordance with the stored PWM signals (i.e., pixel operation instructions). A reset command, at block 270, causes the PWM signals to be executed by select pixels, in accordance with the predetermined bit sequences generated above. In one embodiment, a global reset may be done on the DMD, where none of the pixels are activated in accordance with the PWM signals until all of the PWM signals have been loaded. In other embodiments, group resets may be performed across the DMD, where predetermined groups of pixels (typically grouped based on association with generating the same portion of the image) are operated once the PWM signals for those pixels have been loaded. At the same time, however, PWM signals for other pixels may still be in the process of being loaded. In such embodiments, the speed and efficiency of the DMD may be increased by overlapping unrelated loads and resets. After the selected pixels on the DMD have been operated, the process then moves to an end step 280, where the process may be repeated for the next images to be generated by the pixels.

Looking now at FIG. 3, illustrated is a table that sets forth bit-weights for exemplary bit-planes in a typical 8-bit system. The displayed 8 bits (bits B0–B7) are arranged in a linear, binary order, as is typically found in conventional systems. As mentioned above, the bit-weights in the illustrated bit-planes are converted to PWM signals for use in operating the DMD within an SLM-based visual display system. As illustrated, all of the bit-weights are selected for each bit-plane shown in FIG. 3 (e.g., bit-planes 1–3) using conventional non-neutral density (non-ND) bits. "Non-ND bits" refers to those bits where the intensity of the light projected onto the DMD for executing those bits is not reduced in order to extend the on-time for the selected pixels.

In such approaches, to illustrate a "1" in the first bit-plane using the available 8 bits, B0 (with a bit-weight of $2^0=1$) is turned ON, while the remaining seven bits are turned OFF. Since B0 is the shortest of the 8 bits (for example, 1/256 of a frame-time in 60 Hz embodiment), it is considered the LSB. To illustrate a "2" in the second bit-plane, B1 (with a bit-weight of $2^1=2$) is turned ON while the remaining bits are turned OFF. Then, to illustrate a "3" in the third bit-plane, B0 (with a bit-weight of $2^0=1$) and B2 (with a bit-weight of $2^1=2$) are both turned ON (3=B0+B1), while the remaining bits are turned OFF. Of course, other larger bit-weights than those illustrated in FIG. 3 may also be generated in other bit-planes, depending on the desired application.

Referring now to FIG. 4, illustrated is a table that sets forth bit-weights for exemplary bit-planes in an 8-bit system employing ND bits, in accordance with the related disclosures cited above. The displayed 8 bits (bits B0–B7) are again arranged in a linear, binary order, but now include decimals (or percentages) of whole bits, in accordance with an ND approach. As such, the bit-weights selected for the non-ND bits are bits B4–B7, while those selected for ND bit-weights are bits B0–B3.

For the "ND" bits, the intensity of the light projected onto the DMD for executing those bits is reduced in order to extend the on-time for the selected pixels. By extending the on-time, bits that would normally be too short to use (i.e., their pulse-width is shorter than the time need to load and reset the DMD to execute that bit) may be added back into use by reducing the intensity of such bits in proportion to the extended on-time. ND bits may be executed by passing light through specially engineered sections on a filter (e.g., a color wheel), before illuminating the DMD with that light. The engineered sections of such a filter are manufactured with less transmissivity (i.e., greater optical density) than the remaining portions of the filter, which are the non-ND sections and which do not serve to decrease the intensity of light passing therethrough. As a result, the pulse-widths of ND bits have an initial pulse-width (i.e., before being shifted to an ND bit) less than the load-time, and an adjusted pulse-width equal to the initial pulse-width multiplied by a ratio of the high transmissivity portion of the filter to the low transmissivity portion. This relationship is set forth in equation (1):

$$PW_{ND} = PW_0 \times \frac{\text{non} - ND\tau_\lambda}{ND\tau_\lambda} \tag{1}$$

where $PW_{ND}$ is the pulse-width of the bit in ND, $PW_0$ is the pulse-width of the bit before shifting to ND, and $\tau_\lambda$ is the transmittance of the ND and non-ND filter sections. For a more thorough discussion of ND shifting, reference may be made to the '303 patent mentioned above.

With the combination of ND bits and non-ND bits shown in FIG. 4, to illustrate a "1" in the first bit-plane using the available 8 bits, B2 is turned ON, while the remaining seven bits are turned OFF. To illustrate a "2" in the second bit-plane, B3 is turned ON while the remaining bits are turned OFF. Then, to illustrate a "3" in the third bit-plane, B2 and B3 are both turned ON (3=B2+B3), while the remaining bits are turned OFF. Unfortunately, however, due to the preset bit-weights of the available 8 bits, a combination of ND and non-ND bits may not be employable at the lowest grayscales (e.g., the lowest bit-planes).

Generally, when elevating intensity by beginning with the least significant bits (i.e., the lowest grayscales), architectures that include ND bits will demonstrate a notable transition from ND bits to non-ND bits. Thus, if both types of bits are employed, a smoother transition may be provided by multiplexing or intermixing ND bits with non-ND bits while elevating intensity. Moreover, such undesirable transitions are typically more noticeable at lower intensities. As a result, such multiplexing of bit types may only need to be done at lower intensities, when transitions between the two are more noticeable to viewers of the display system. Thus, a multiplexing of ND and non-ND bits should be done at the least significant bits, and an example of this multiplexing is discussed with reference to FIG. 5.

Turning now to FIG. 5, illustrated is another table that sets forth bit-weights for exemplary bit-planes in an 8-bit system employing ND bits and non-ND bits, in accordance with the principles disclosed herein. The displayed 8 bits (bits B0–B7) are again arranged in a linear, binary order, and still include decimals (or percentages) of whole bits, in accordance with the use of ND bits mentioned above. Also as before, the bit-weights selected for the non-ND bits are bits B4–B7, while those selected for ND bit-weights are bits B0–B3.

With the combination of ND bits and non-ND bits shown in FIG. 5, the lowest bit-planes may be generated with both ND and non-ND bits as intensity is increased. For example, to illustrate a "1" in the first bit-plane using the available 8 bits, B2 is again turned ON, while the remaining seven bits are turned OFF. To illustrate a "2" in the second bit-plane, B3 or B4 may be turned ON, while the remaining bits are turned OFF, since the bit-weights of the 8 bits have been shifted such that the same bit-weight is available in either an ND bit or a non-ND bit. However, the shifted bit-weights are now useful to employ both ND and non-ND bits, for example, when a "3" is illustrated" in the third bit-plane. More specifically, to illustrate the "3", B2 and B4 are both turned ON (3=B2+B4), while the remaining bits are turned OFF. Thus, the "3" may be represented by a combination of an ND bit (B2) and a non-ND bit (B4), rather than all ND bits or all non-ND bits.

As discussed above, by multiplexing ND and non-ND bits to create an intensity for the DMD to display, the transition between ND bits and non-ND may be eliminated. Of course, while multiple bits with a weight of "2" for ND and non-ND bits are illustrated, these principles may be applied to shift any bit-weight. For example, the bit-weights may be shifted to create multiple bit-weights of "1" such that a "2" may be displayed using multiplexed ND and non-ND bit-weights of 1. Furthermore, such multiplexing may be used to create multiple combined bits from the LSB and higher, as the energy on the DMD transitions from solely ND to solely non-ND at higher intensities. Accordingly, hard boundaries between ND and non-ND bits are eliminated as the energy ramps upwards to a full color and fully illuminated image.

To accomplish the multiplexing of the ND and non-ND bits, several existing techniques may be employed. For example, in some embodiments, spatial-temporal multiplexing (STM) circuitry may be employed with the SLM to provide the shifting and bit-weights in the available bits, and thus a seamless intermixing of selected bits. For a detailed discussion of STM circuitry and its application to DMD bit-sequencing, reference is made to U.S. Pat. No. 6,310,591 entitled "Spatial-Temporal Multiplexing for High Bit-Depth Resolution Displays," which is commonly assigned with the present disclosure and incorporated herein by reference in its entirety. In alternative embodiments, boundary dispersion tables may be employed, such as those used in techniques conventionally available. Of course, the principles disclosed herein are not limited to any particular technique for multiplexing the ND and non-ND bits as described above.

Looking finally at FIG. 6, illustrated is another table having bit-weights for a given set of bit-planes in another embodiment of an 8-bit system. As with the embodiment in FIG. 5, this embodiment also includes ND bits and non-ND bits, in accordance with the principles disclosed herein. In FIG. 6, the bit-weights selected for ND bit-weights are bits B0–B2, while those selected for the non-ND bits are bits B3–B7.

In contrast to the previous embodiments discussed above, the displayed 8 bits (bits B0–B7) in FIG. 6 are not arranged in a linear or binary order. Instead, this embodiment illustrates the ability to shift bit-weights in any desired manner, while still separating the bit into ND and non-ND bits. As illustrated, the bits may be arranged in ternary order, rather than being limited to a binary arrangement. In addition, any of the ND bits may also be fractions of the non-ND bits based on a factor of 3 (e.g., ⅔, ⅓, etc.), rather than a factor of 2 (e.g., ½, ¼, etc.). Of course, other embodiments according to the principles disclosed herein are not limited to ternary arrangements. Instead, any number may be used as the base for the arrangement or ordering of the bits. Moreover, the bit-weights need not be arranged in exponential order (e.g., $\mathbf{3}^0$, $\mathbf{3}^1$, $\mathbf{3}^2$, $\mathbf{3}^3$, etc.). Rather, as illustrated in the table of FIG. 6, the bit-weights may be in non-exponential ascending order.

Furthermore, the bits in the bit sequences may be weighted in an ascending order having a common base number. For example, bit-weights such as 1, 2, 3, 7, 11, 15, 20, and 31 may be used for bits B0–B7, allowing for a larger range of possibilities for instructing the DMD to illustrate desired bit-planes with a combination of ND and non-ND bits. In such embodiments, the bit-weights may be selected at random, so long as their sum approximately totals the available time period for illustrating the bit sequence of a bit-plane. In some cases, the available time may be proportional to the size of the color segment on the color wheel employed, e.g., the length of time the light source passes through a given filter color segment and illuminates the DMD to generate a piece of the final image.

With the ternary arrangement of ND bits and non-ND bits shown in FIG. 6, to illustrate a "3" using the available 8 bits, B3 in the non-ND area is turned ON, while the remaining seven bits are turned OFF. However, to illustrate a "4", bits B2 and B3 are turned ON, while the remaining bits are turned OFF. The combination of bits B2 and B3 (4=B2+B3) allows the selection of bits in both the ND and non-ND areas to allow the smoother and more seamless transition described above as the power in the DMD is elevated. Moreover, to illustrate a "5", bits B0, B1, B2 and B3 may all be turned ON (5=B0+B1+B2+B3), while the remaining bits are turned OFF. Thus, illustrating the "5" may also be accomplished using a combination of both ND and non-ND bits. Of course, the use of combined ND and non-ND bits may also be possible regardless of the number used as the base for the arrangement of the bit-weights. Moreover, employing a combination of ND and non-ND bits as the power in the DMD is elevated to fully display the desired image, reduces or eliminates the loss of color performance typically caused by the static transitions visually detectable when passing from all ND to all non-ND bits in the lower intensity bit-planes. As a result, a better quality image without visible boundaries is provided.

While various embodiments of DMD-based visual display devices and associated methods according to the principles disclosed herein, have been described above, it should be understood that they have been presented by way of example only, and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention (s), and their equivalents, that are protected thereby. In all instances, the scope of the claims shall be considered on their own merits in light of the specification, but should not be constrained by the headings set forth herein.

What is claimed is:

1. A method of displaying an image, the method comprising:

transmitting light through an optical filter comprising at least one high transmissivity portion configured to output light at an initial intensity and at least one low transmissivity portion configured to output light at a lower intensity than the initial intensity;

illuminating a spatial light modulator with the initial intensity and lower intensity output light;

providing a plurality of data bits from a predetermined number of data bits, each of the plurality comprising a pulse having a pulse-width longer than a load-time for operating the spatial light modulator;

providing at least one data bit from the predetermined number of data bits, the at least one data bit comprising a pulse having an initial pulse-width less than the load-time and an adjusted pulse-width greater than the load-time, the pulse of the at least one data bit corresponding at least in part to when the at least one low transmissivity portion outputs the lower intensity light; and operating selected portions of the spatial light modulator in coordination with the initial intensity and lower intensity output light using the pulse-widths of one or more of the plurality of data bits and the adjusted pulse-width of the at least one data bit.

2. A method according to claim 1, wherein the adjusted pulse-width is equal to the initial pulse-width multiplied by a ratio of the high transmissivity portion to the low transmissivity portion of the optical filter.

3. A method according to claim 1, further comprising operating such that the selected portions of the spatial light modulator operate based on the at least one data bit at least when the lower intensity output light is transmitted from the at least one low transmissivity portion of the optical filter.

4. A method according to claim 1, further comprising operating selected portions of the spatial light modulator using the pulse-widths, wherein the pulse-width of one or more of the plurality of data bits substantially equals the adjusted pulse-width of the at least one data bit.

5. A method according to claim 1, further comprising transmitting light through an optical filter comprising three high transmissivity portions and three low transmissivity portions.

6. A method according to claim 5, wherein the three high transmissivity portions comprise red, green, and blue portions, and the three low transmissivity portions comprise neutral density red, neutral density green, and neutral density blue portions.

7. A method according to claim 1, wherein the transmitting comprises transmitting light through a color wheel.

8. A method according to claim 1, further comprising operating selected portion of the spatial light modulator using the pulse-widths, wherein the collective pulse-widths of the predetermined number of data bits substantially equals a frame-time during which a single frame of the image is displayed.

9. A method according to claim 1, wherein the predetermined number of data bits comprises a bit-plane for displaying a portion of a frame of the image, and the image comprises a plurality of bit-planes corresponding to grayscales of the image.

10. A method according to claim 9, further comprising three groups of the predetermined number of data bits, each group comprising a bit-plane for corresponding red, green, and blue colors to be displayed.

11. A method according to claim 1, wherein the predetermined number of data bits are weighted in non-binary order.

12. A method according to claim 1, wherein the predetermined number of data bits is 8.

13. A method according to claim 1, wherein the load-time is about 40 μsec.

14. A method according to claim 1, wherein the lower intensity output light varies as a function of the time during which an input light passes through the at least one low transmissivity portion.

15. A method according to claim 1, wherein the spatial light modulator comprises an array of micro-mirrors.

16. A visual display device, comprising:

an optical filter configured to transmit light therethrough and onto a spatial light modulator, the optical filter comprising at least one high transmissivity portion configured to output light at an initial intensity, and at least one low transmissivity portion configured to output light at a lower intensity than the initial intensity;

a plurality of data bits from a predetermined number of data bits, each of the plurality comprising a pulse-width longer than a load-time for operating the spatial light modulator; and at least one data bit from the predetermined number of data bits, the at least one data bit comprising an initial pulse-width less than the load-time and comprising an adjusted pulse-width greater than the load-time, selected portions of the spatial light modulator configured to operate in coordination with the initial intensity and lower intensity output light based on the pulse-widths of one or more of the plurality of data bits and the adjusted pulse-width of the at least one data bit.

17. A visual display device according to claim 16, wherein the adjusted pulse-width is equal to the initial pulse-width multiplied by a ratio of the high transmissivity portion to the low transmissivity portion of the optical filter.

18. A visual display device according to claim 16, wherein selected portions of the spatial light modulator are further configured to operate based on the at least one data bit at least when the lower intensity output light is transmitted from the at least one low transmissivity portion of the optical filter.

19. A visual display device according to claim 16, wherein the pulse-width of one or more of the plurality of data bits substantially equals the adjusted pulse-width of the at least one data bit.

20. A visual display device according to claim 16, wherein the optical filter comprises three high transmissivity portions and three low transmissivity portions.

21. A visual display device according to claim 16, wherein the three high transmissivity portions comprise red, green, and blue portions, and the three low transmissivity portions comprise neutral density red, neutral density green, and neutral density blue portions.

22. A visual display device according to claim 16, wherein the optical filter is a color wheel.

23. A visual display device according to claim 16, wherein the collective pulse-widths of the predetermined number of data bits substantially equals a frame-time during which a single frame of the image is displayed.

24. A visual display device according to claim 16, wherein the predetermined number of data bits comprises a bit-plane for displaying a portion of a frame of the image, and the image comprises a plurality of bit-planes corresponding to grayscales of the image.

25. A visual display device according to claim 24, further comprising three groups of the predetermined number of data bits, each group comprising a bit-plane for corresponding red, green, and blue colors to be displayed.

26. A visual display device according to claim 16, wherein the predetermined number of data bits are arranged in non-binary order.

27. A visual display device according to claim 16, wherein the predetermined number of data bits is 8.

28. A visual display device according to claim 16, wherein the load-time is about 40 μsec.

29. A visual display device according to claim 16, wherein the lower intensity output light varies as a function of the time during which an input light passes through the at least one low transmissivity portion.

30. A visual display device according to claim 16, wherein the spatial light modulator comprises an array of micro-mirrors.

* * * * *